US005205770A

United States Patent [19]

Lowrey et al.

[11] Patent Number: 5,205,770

[45] Date of Patent: Apr. 27, 1993

[54] METHOD TO FORM HIGH ASPECT RATIO SUPPORTS (SPACERS) FOR FIELD EMISSION DISPLAY USING MICRO-SAW TECHNOLOGY

[75] Inventors: Tyler A. Lowrey; Trung T. Doan; David A. Cathey; J. Brett Rolfson, all of Boise, Id.

[73] Assignee: Micron Technology, Inc., Boise, Id.

[21] Appl. No.: 851,036

[22] Filed: Mar. 12, 1992

[51] Int. Cl.[5] ..... H01J 1/88

[52] U.S. Cl. ..... 445/24; 445/33; 313/268; 313/292

[58] Field of Search ..... 445/24, 25, 33; 313/268, 292

[56] References Cited

U.S. PATENT DOCUMENTS

| | | | |
|---|---|---|---|
| 3,665,241 | 5/1972 | Spindt et al. | 313/351 |
| 3,755,704 | 8/1973 | Spindt et al. | 313/309 |
| 3,812,559 | 5/1974 | Spindt et al. | 445/50 |
| 3,843,427 | 10/1974 | Esdonk et al. | 156/3 |
| 3,875,442 | 4/1975 | Wasa et al. | 313/193 |
| 3,953,756 | 4/1976 | Monfroy et al. | 313/220 |
| 4,091,305 | 5/1978 | Poley et al. | 359/54 |
| 4,183,125 | 1/1980 | Meyer et al. | 313/495 |
| 4,422,731 | 12/1983 | Droguet et al. | 445/24 |
| 4,451,759 | 5/1984 | Heynisch et al. | 313/586 |
| 4,923,421 | 5/1990 | Brodie et al. | 445/24 |

FOREIGN PATENT DOCUMENTS

| | | | |
|---|---|---|---|
| 60-49626 | 3/1985 | Japan | 445/25 |
| 1-220330 | 9/1989 | Japan | 445/24 |
| 2-165540 | 6/1990 | Japan | 445/24 |
| 3-179630 | 8/1991 | Japan | 445/24 |

*Primary Examiner*—Richard K. Seidel
*Assistant Examiner*—Jeffrey T. Knapp
*Attorney, Agent, or Firm*—Lia M. Pappas

[57] ABSTRACT

Fabrication of spacer supports for use in field emitter displays through a process which involves 1) forming a mold for the spacers in a substrate through the use of micro-saw technology, 2) filling the mold with a material that is selectively etchable with respect to the mold, 3) optionally, planarizing the excess material to the level of the mold using chemical mechanical planarization, 4) attaching the filled mold to one of the electrode plates of the field emitter display, and 5) etching away (removing) the mold, after which 6) the plate can be aligned with its complementary electrode plate, and 7) a vacuum formed.

20 Claims, 5 Drawing Sheets

METHOD TO FORM HIGH ASPECT RATIO SUPPORTS (SPACERS) FOR FIELD EMISSION DISPLAY USING MICRO-SAW TECHNOLOGY

FIELD OF THE INVENTION

This invention relates to field emission devices, and more particularly to processes for creating the spacer structures which can provide support against the atmospheric pressure on the flat panel display without impairing the resolution of the image.

BACKGROUND OF THE INVENTION

Cathode ray tube (CRT) displays, such as those commonly used in desk-top computer screens, function as a result of a scanning electron beam from an electron gun impinging on phosphors on a relatively distant screen. The electrons increase the energy level of the phosphors. When the phosphors return to their normal energy level, they release photons which are transmitted through the glass screen of the display to the viewer.

Flat panel displays seek to combine the cathodoluminescent-phosphor technology of CRTs with integrated circuit technology to create thin, high resolution displays wherein each pixel is activated by its own electron emitter. This type of display technology is becoming increasingly important in appliances requiring lightweight portable screens.

It is important in flat panel displays of the field emission cathode type that an evacuated cavity be maintained between the cathode electron emitting surface and its corresponding anode display face (also referred to as an anode, cathodoluminescent screen, display screen, faceplate, or display electrode).

There is a relatively high voltage differential (e.g., generally above 200 volts) between the cathode emitting surface (also referred to as base electrode, baseplate, emitter surface, cathode surface) and the display screen. It is important that electrical breakdown between the electron emitting surface and the anode display face be prevented. At the same time, the narrow spacing between the plates is necessary to maintain the desired structural thinness and to obtain high image resolution. The spacing also has to be uniform for consistent image resolution, and brightness, as well as to avoid display distortion, etc. Uneven spacing is much more likely to occur in a field emission cathode, matrix addressed flat vacuum type display than in some other display types because of the high pressure differential that exists between external atmospheric pressure and the pressure within the evacuated chamber between the baseplate and the faceplate. The pressure in the evacuated chamber is typically less than $10^{-6}$ torr.

Small area displays (e.g., those which are approximately 1" diagonal) do not require spacers, since glass having a thickness of approximately 0.040" can support the atmospheric load, but as the display area increases, spacer supports become more important. For example, a screen having a 30" diagonal measurement will have several tones of atmospheric force exerted upon it. As a result of this tremendous pressure, spacers will play an essential role in the structure of the large area, light weight, displays.

Spacers are incorporated between the display faceplate and the baseplate upon which the emitter tips are fabricated. The spacers, in conjunction with thin, lightweight, substrates support the atmospheric pressure, allowing the display area to be increased with little or no increase in substrate thickness.

Spacer structures must conform to certain parameters. The supports must 1) be sufficiently non-conductive to prevent electrical breakdown between the cathode array and the anode, in spite of the relatively close interelectrode spacing (which may be on the order of 100 microns), and relatively high interelectrode voltage differential (which may be on the order of 200 or more volts); 2) exhibit mechanical strength such that they exhibit only slow deformation over time to provide the flat panel display with an appreciable useful life; 3) exhibit stability under electron bombardment, since electrons will be generated at each of the pixels; 4) be capable of withstanding "bakeout" temperatures of around 400° C. that are required to create the high vacuum between the faceplate and backplate of the display; and 5) be of small enough size so as to not to visibly interfere with display operation.

Various types of spacers have been developed. A few examples are disclosed in U.S. Pat. No. 4,183,125, entitled "Gas Panel Spacer Technology," U.S. Pat. No. 4,091,305, entitled "Method of Making an Insulator-support for Luminescent Display Panels and the Like," U.S. Pat. No. 4,422,731, entitled "Display Unit with Half-stud, Spacer, Connection Layer and Method of Manufacturing," and U.S. Pat. No. 4,451,759, entitled "Flat Viewing Screen with Spacers between Support Plates and Method of Producing Same".

U.S. Pat. No. 4,923,421 entitled, "Method for Providing Polyimide Spacers in a Field Emission Panel Display," discloses the use of spacer supports in field emission displays. In the above mentioned patent, Brodie et al. describe a process wherein spacers are formed by applying a layer of material to one of the plate surfaces, patterning the material, and then removing the material except for the portions which form the spacers.

There are several drawbacks to the spacers and methods described in the above cited patents. One disadvantage is need for the spacer supports to be relatively large, having diameters in the range of 50 microns, in order to render innocuous the small amount of isotropic distortion (i.e., undercutting of the spacers) that inevitably occurs during anisotropic (plasma) etches. In other words, if the spacers are too narrow, they will tend to bend slightly during the etching process which is used to eliminate the material surrounding the spacer.

Those known processes which involve the use of attaching and aligning pre-made spacers to the electrodes are very unreliable, tedious and expensive.

SUMMARY OF THE INVENTION

The object of the present invention is to fabricate spacer supports for use in field emitter displays through a process which involves forming a mold for the spacers in a substrate through the use of micro-saw technology, filling the mold with a material that is selectively etchable with respect to the mold, attaching the filled mold to one of the electrode plates of the field emitter display, and etching away (removing) the mold, after which the plate can be combined with its complementary electrode plate, and a vacuum formed.

A further objective is to fabricate high aspect ratio support structures that will not interfere with the display resolution. The spacers formed by the process of the invention have a width of approximately 25–30 microns which is invisible to the human eye when it occurs in a pixel having a width of approximately 170 microns.

BRIEF DESCRIPTION OF THE DRAWINGS

The present invention will be better understood from reading the following description of nonlimitative embodiments, with reference to the attached drawings, wherein below.

It should be emphasized that the drawings of the instant application are not to scale but are merely schematic representations and are not intended to portray the specific parameters or the structural details of a flat panel display which are well known in the art.

DETAILED DESCRIPTION OF THE INVENTION

Figure 1:
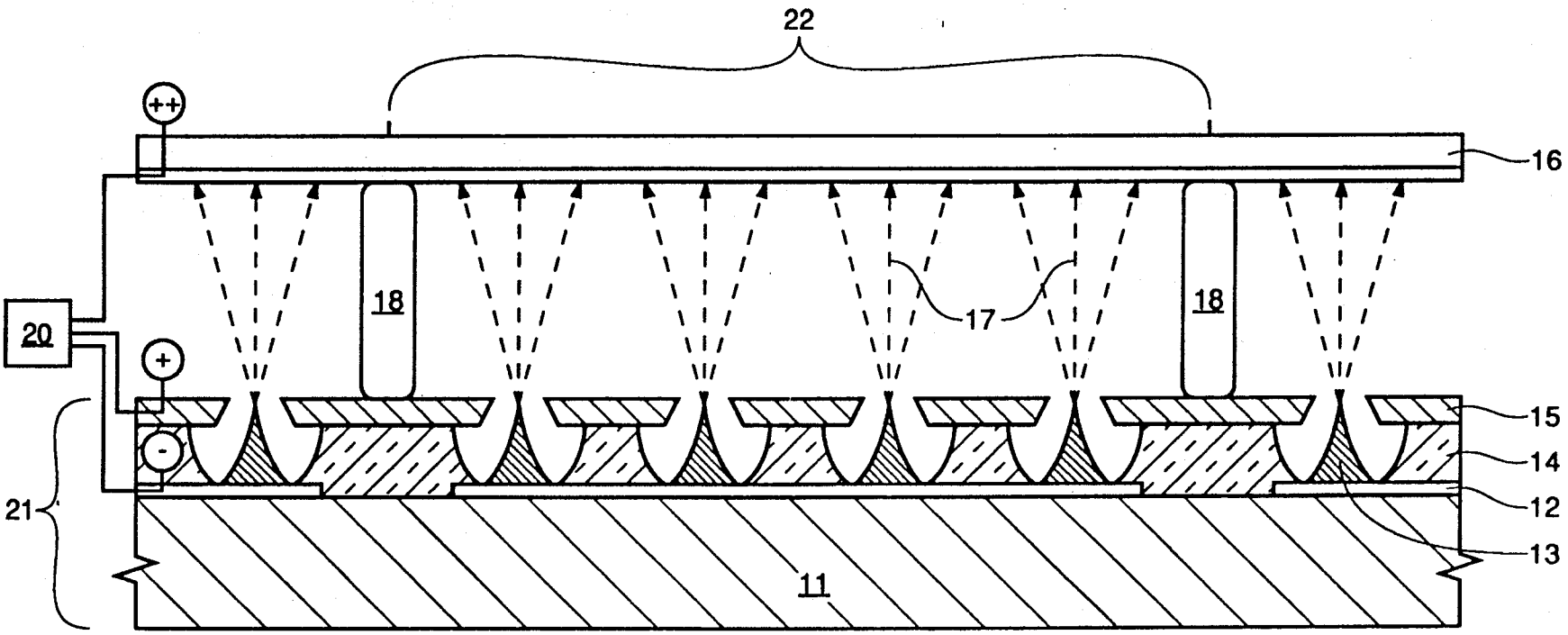
FIG. 1 is a cross-sectional schematic drawing of a pixel of a field emission display consisting of a faceplate with a phosphor screen, vacuum sealed to a baseplate which is supported by the spacers formed using the process of the present invention.

Referring to FIG. 1, a pixel 22 of a field emission display employing a coldcathode is depicted. A single crystal silicon layer serves as a substrate 11 onto which a conductive material layer 12, such as doped polycrystalline silicon has been deposited. At the field emission cathode site locations, conical micro-cathodes 13 have been constructed on top of the substrate 11. Surrounding the micro-cathodes 13, is a micro-anode gate structure 15. When a voltage differential, through source 20, is applied between the cathode 13 and the gate 15, a stream of electrons 17 is emitted toward a phosphor coated screen 16. The display screen 16 serves as an anode. The electron emission tips 13 are integral with the single crystal semiconductor substrate 11, and serve as a cathode conductor. Gate 15 serves as a low potential anode or grid structure for the cathodes tips 13. An insulating layer 14 is deposited on the conductive cathode layer 12. The insulator 14 also has openings at the field emission site locations. Support structure 18, also referred to as a spacers, are located between the display faceplate 16 and the baseplate 21.

In U.S. Pat. No. 3,875,442, entitled "Display Panel," Wasa et al. disclose a display panel comprising a transparent gas-tight envelope, two main planar electrodes which are arranged within the gas-tight envelope parallel with each other and a cathodoluminescent panel. Spindt et. al. disclose field emission cathode structures in U.S. Pat. Nos. 3,665,241; 3,755,704; and 3,812,559.

The invention can best be understood with reference to FIGS. 2–7 of the drawings which depict the initial, intermediate, and final structures produced by a series of manufacturing steps according to the present invention.

Figure 2:
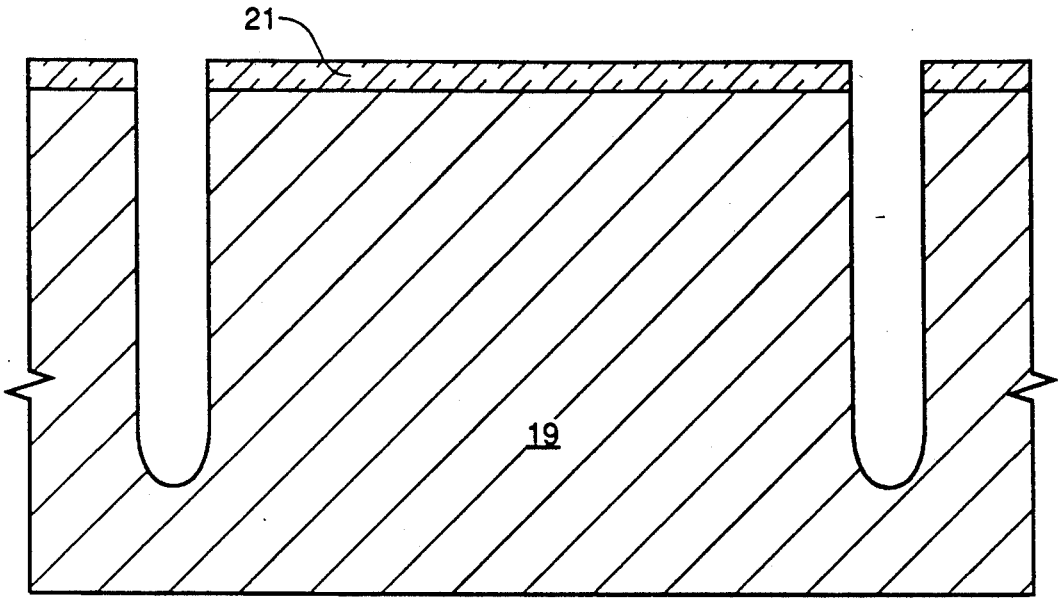
FIG. 2 is a cross-section of the substrate after the spacer grooves have been cut with a micro-saw to form a mold according to the process of the present invention.
Figure 8:
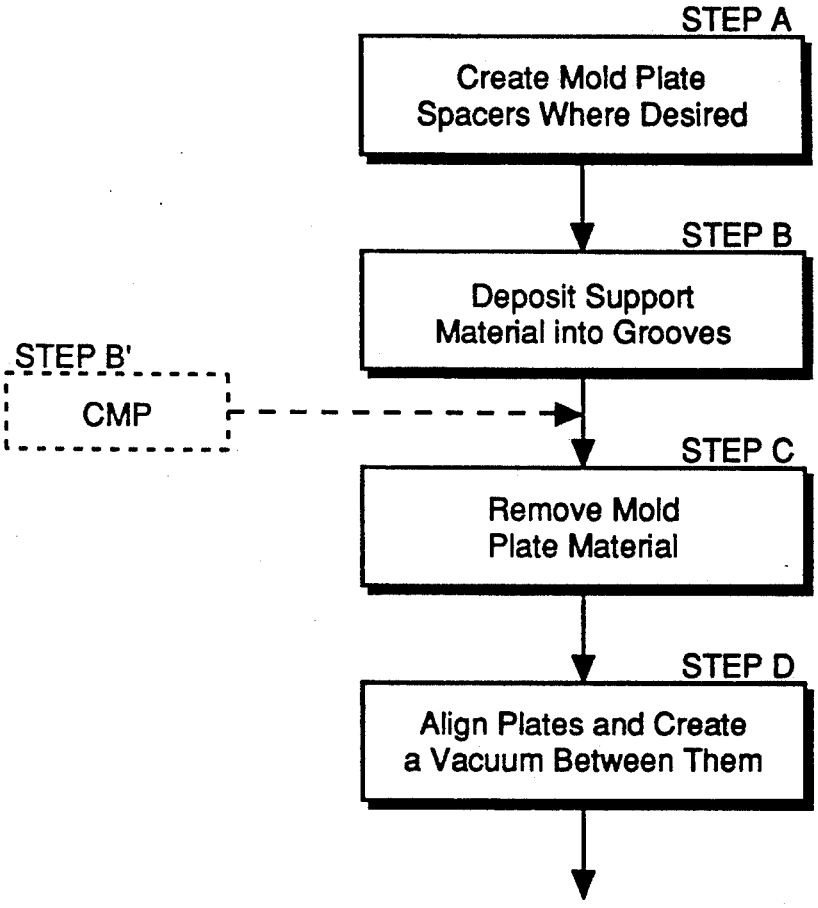
FIG. 8 is a flow diagram of the steps involved in the spacer forming process in accordance with the present invention.

The fabrication of spacer supports 18 begins with the creation of a .mold 19 having the desired shape and dimensions of the spacer structures 18 to be produced (Step A of FIG. 8). In the preferred embodiment, a suitable selectively-etchable substrate, for example, a silicon wafer or glass, is grooved in the locations where the high aspect ratio support structures 18 are to be formed (FIG. 2). Preferably, the grooves are cut substantially parallel to one another, and substantially perpendicular to the surface of the substrate into which they are made.

The substrate may optionally be laminated or deposited with a suitable material 21, which is selectively etchable with respect to the spacer structures, such as an oxide or a nitride, prior to the formation of the grooves. However, a preferred laminating material is polyimide tape.

Micro-saws having tips preferably made of diamond, or other suitable material can be used to cut ultra-fine, accurately placed slits or grooves into the wafer. By selecting the appropriate blade size and cutting depth, one is able to control the height and width of the spacer supports 18. The preferred width of a spacer support 18 is in the approximate range of 5–25 microns, and the preferred height is approximately 50–200 microns, but the spacer supports can also be in the range of 1 micron. The high aspect ratio support structures 18 preferably have a height to width aspect ratio of 5:1 or more.

An alternative embodiment would be to use drills having micro-fine bits to drill cylindrical bores in the mold and thereby create column or pillar type spacer structures using the method of the present invention.

Figure 3:
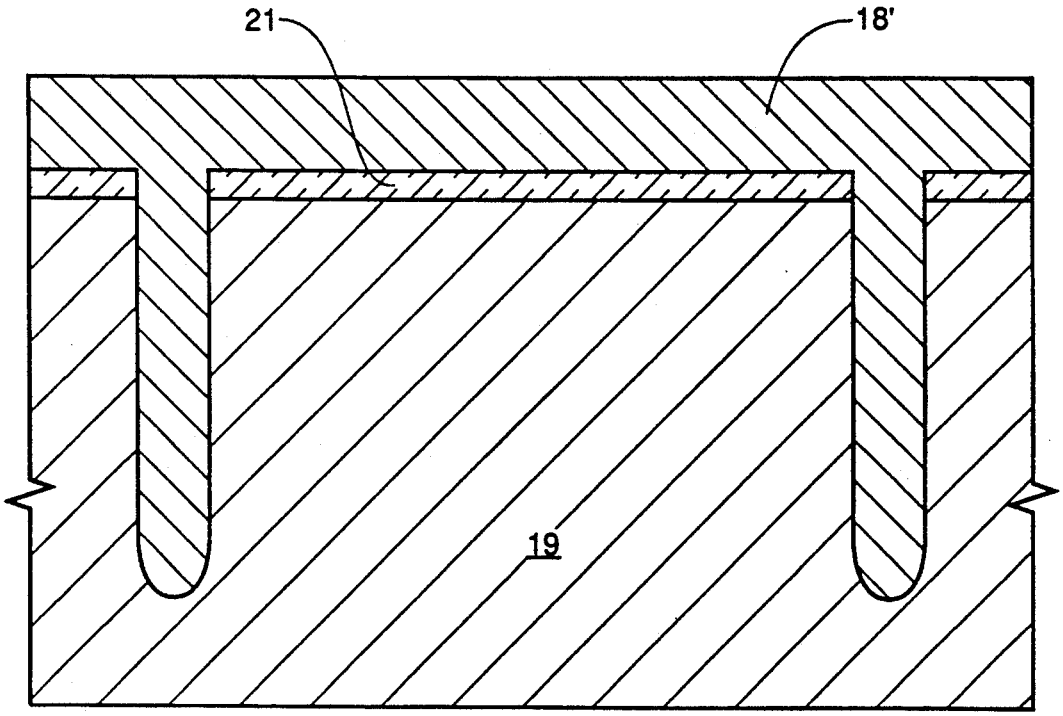
FIG. 3 is a cross-section of the mold filled with the spacer forming material according to the process of the present invention.

The next process step (Step B of FIG. 8) is to deposit a preferably thick support material 18' into the grooves of the mold. The support material 18' is perferably, silicon nitride ($Si_3N_4$), but any other suitable material could be used. FIG. 3 illustrates a mold 19 which has been filled with the support material 18'.

An alternative embodiment would be to fill the mold 19 with the spacer material 18' through the use of injection molding, or other fill technology.

Figure 4:
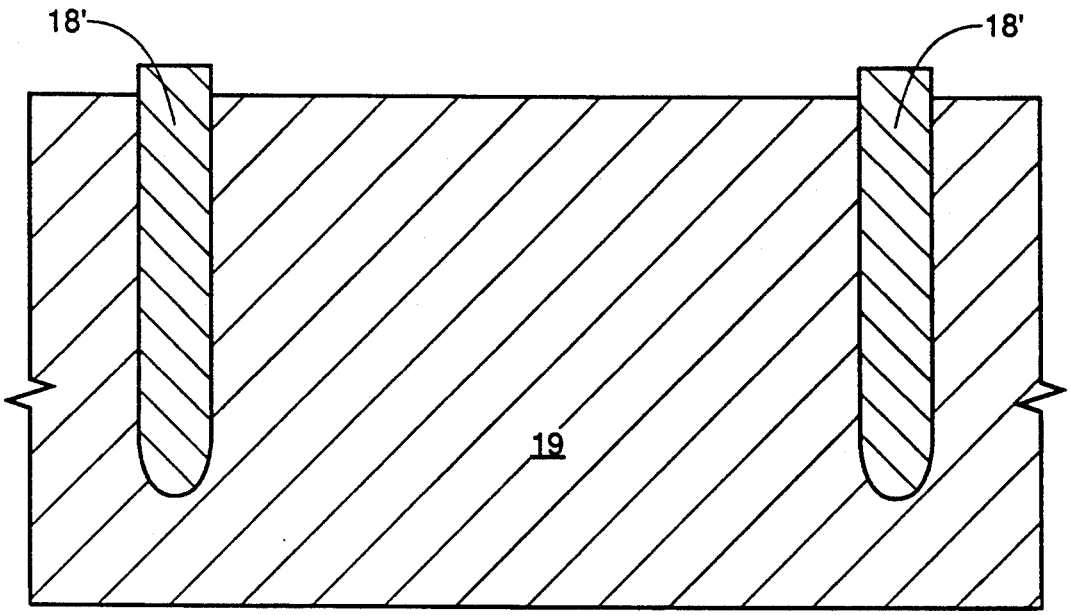
FIG. 4 is a cross-section of the filled mold of FIG. 3 after it has undergone chemical mechanical planarization (CMP) on one side according to the process of the present invention.
Figure 6:
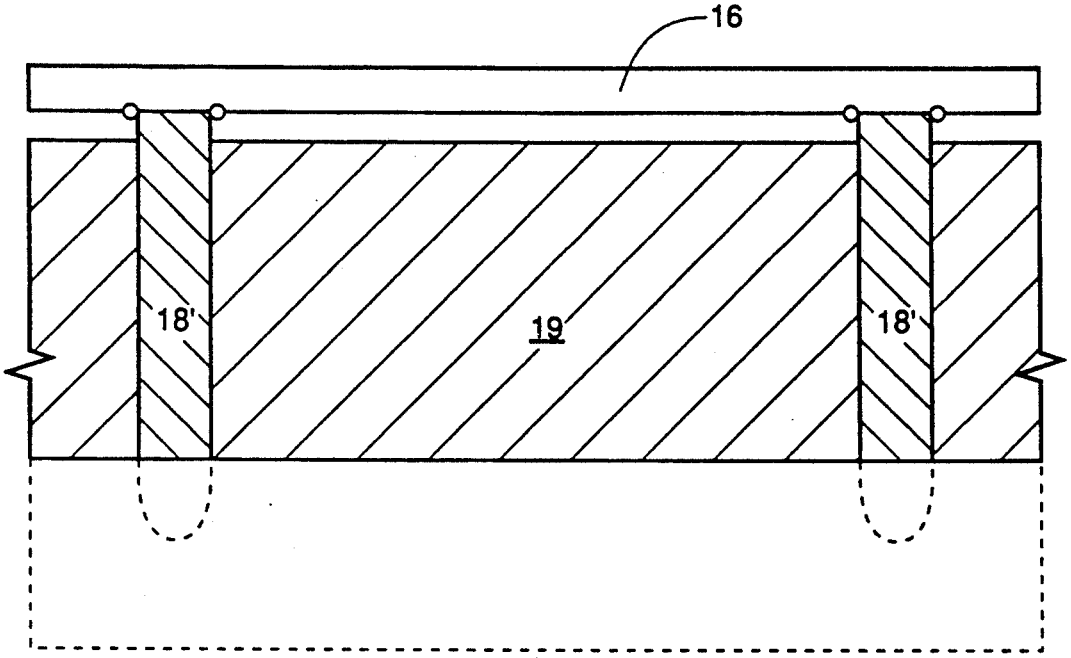
FIG. 6 is a cross-section of the filled mold of FIG. 5, which has undergone CMP on both sides of the mold according to the process of the present invention.

The next step in the spacer formation process (Step B' of FIG. 8) is optional and involves chemical mechanical planarization (CMP), also referred to in the art as chemical mechanical polishing (CMP). If it is desired, the spacer material 18' extending beyond the mold 19 may be "polished" away through the use of chemical and abrasive techniques (FIG. 4). Additionally, the opposite side, i.e., the tip, of the mold plate 19 may also be "polished" down to obtain the chosen height of the support structure 18 (FIG. 6).

In general, CMP involves holding or rotating a wafer of semiconductor material against a wetted polishing surface under controlled chemical slurry, pressure, and temperature conditions. A chemical slurry containing a polishing agent such as alumina or silica may be utilized as the abrasive medium. Additionally, the chemical slurry may contain chemical etchants. This procedure may be used to produce a surface with a desired endpoint or thickness, which also has a polished and planarized surface. Such apparatus for polishing are disclosed in U.S. Pat. Nos. 4,193,226 and 4,811,522. Another such apparatus is manufactured by Westech Engineering and is designated as a Model 372 Polisher.

CMP will be performed substantially over the entire wafer surface, and at a high pressure. Initially, CMP will proceed at a very fast rate, as the excess material 18' removed, then the rate will slow dramatically after the excess material 18' has been substantially removed. The removal rate of the CMP is proportionally related to the pressure and the hardness of the surface being planarized.

FIG. 4 illustrates the intermediate step in the spacer formation process following the chemical mechanical planarization CMP. A substantially planar surface is achieved on the filled mold 19.

An alternative embodiment would be to use a blanket etch or other suitable technique to planarize the surfaces of the mold, and thereby remove any excess material.

If the mold substrate has been optionally laminated with a selectively etchable material 21, as discussed above, prior to the creation of the spacer grooves, the removal of the laminate 21 at this point will result in spacers 18 which slightly protrude from the mold surface 19. This may facilitate the subsequent attachment of the spacer structures 18 to the electrode plate 16. In such an embodiment, the likelihood of an air gap between the electrode plate 16 and spacer support 18 is minimized, since the protruding spacer structures 18 will contact the electrode plate 16 first, thereby limiting the amount of interference from the mold substrate 16 in the attachment and sealing of the spacers 18 to the plate 16.

Figure 5:
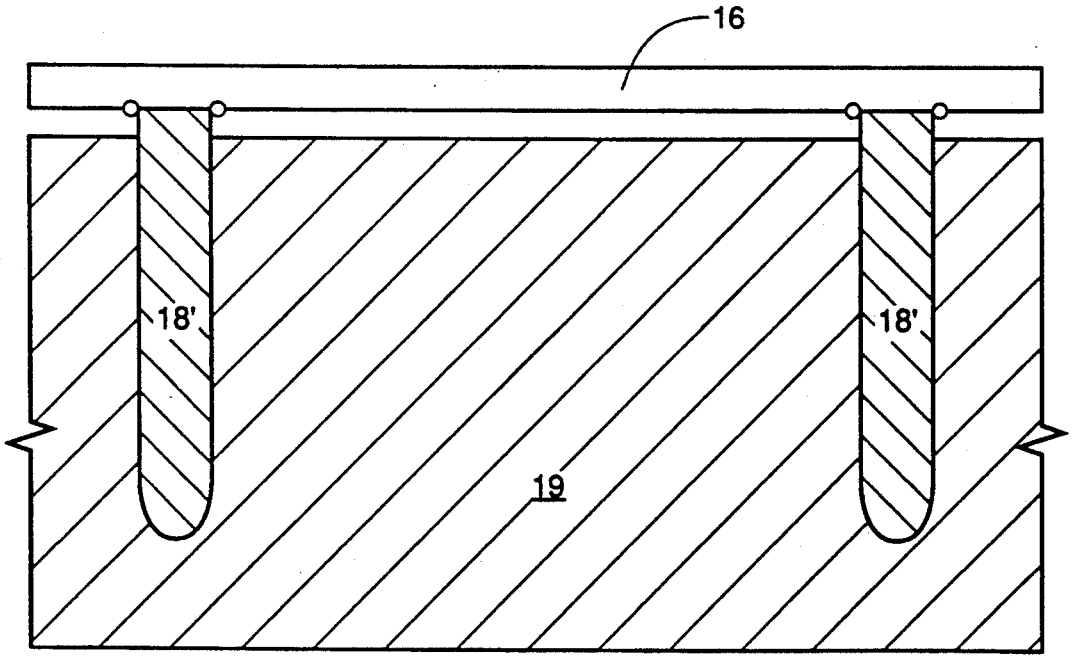
FIG. 5 is a cross-section of the filled mold of FIG. 4, after the filled mold has been attached to an electrode plate according to the process of the present invention.

At this point in the fabrication process, the filled mold plate 19 is attached to one of the electrode plates 16 or 21 of the field emitter display, i.e., to either the cathode conductor base plate 21 or the cathodoluminescent screen display faceplate 16. In the preferred embodiment, the filled silicon mold plate 19 is attached to the anode screen 16 (FIG. 5). The mold plate 19 is sealed to the electrode 16 with a suitable frit seal or other glaze, cement, or synthetic resin. The frit seal involves the use of glass or other vitreous bonding agent preferably having a low melting point, i.e., a non-devitrifying frit. However, a devitrifying glass solder may be used. The plate 19 is bonded preferably in a ring only at the edges of the spacer supports 18. If it is not sealed properly, the field emitter display will bend under the pressure differential between the atmosphere and the vacuum.

Figure 7:
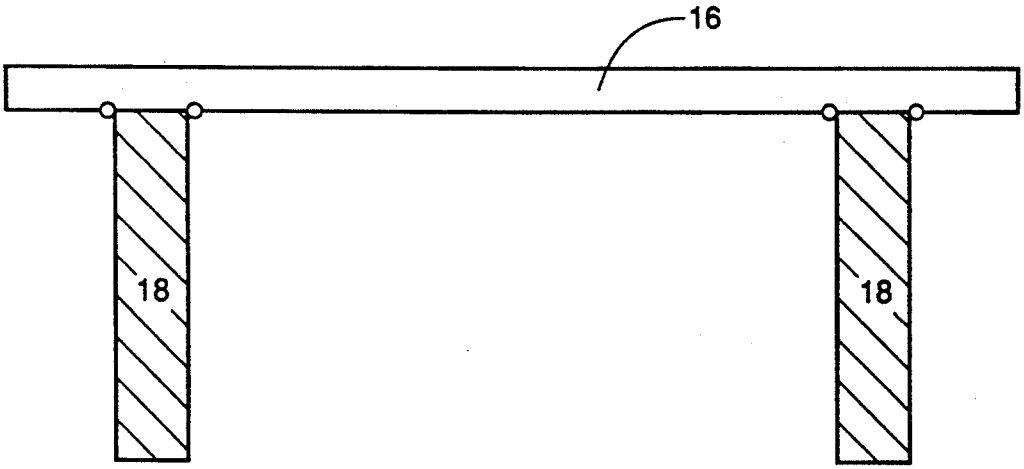
FIG. 7 is a cross-section of the spacer structures of FIG. 6, after the mold has been removed through etching.

The next process step (Step C of FIG. 8) is an etching of the selectively-etchable mold 19 to expose the spacer supports 18 (FIG. 7). If the mold plate 19 is made of silicon dioxide ($SiO_2$), and the support material 18' is comprised of silicon nitride, then it is possible to perform a wet etch in a tank using hydrogen fluoride (HF) to selectively etch away the silicon dioxide mold plate material 19, thereby leaving the $Si_3N_4$ spacer supports 18 intact. Then to blanket etch, or dry etch all the way down.

After the spacers 18 are formed, preferably on the anode 16, i.e., the cathodoluminescent screen, the baseplate 21 and the screen 16 are correctly aligned and fit together. Since the supports 18 are fabricated on one of the plates, the alignment step is easier than it would be if, as in other the devices, the spacer supports were made separately and subsequently attached to both the baseplate 21 and the screen 16. Although it would be possible to fabricate the spacer supports 18 and remove them from the mold 19 prior to attaching them to either electrode plate, using the process of the present invention.

Once the plates have been properly aligned, they can be sealed by a method known in the art, for example, with a frit seal and vacuum created in the space between them. The vacuum is required to prevent Paschen breakdown in the space between the electrodes, i.e., the emitter tips 13 and the cathodolumminscent screen 16.

As previously mentioned, the silicon nitride or polyimide spacers which have been fabricated can tolerate high temperature bakeout, of about 400° C. which is necessary for the creation of the vacuum.

All of the U.S. Patents cited herein are hereby incorporated by reference herein as if set forth in their entirety.

While the particular process as herein shown and disclosed in detail is fully capable of obtaining their objects and advantages herein before stated, it is to be understood that it is merely illustrative of the presently preferred embodiments of the invention and that no limitations are intended to the details of construction or design herein shown other than as described in the appended claims.

We claim:

1. A process for the formation of interelectrode support structures, said process comprising the following steps:

creating a mold in a substrate, said mold being created using a drilling means;

filling said mold with support forming material;

attaching said filled mold to a first electode plate, said support forming material being in contact with said first electrode plate;

removing said mold from said support forming material to expose the support structures;

attaching and sealing said first electrode plate to a second electrode plate; and creating a vacuum between said first electrode plate and said second electrode plate.

2. The process according to claim 1, wherein said mold is selectively etchable with respect to said support forming material.

3. A process for the formation of interelectrode support structures, said process comprising the following steps:

creating a mold in a substrate, said substrate has a first surface; said mold being created using a cutting means for cutting grooves in said substrate substantially perpendicular to said first surface;

filling said mold with support forming material, said mold being selectively etchable with respect to said support forming material;

attaching said mold to a first electrode plate, said support forming material being in contact with said first electrode plate;

removing said mold from said support forming material to expose the support structures;

attaching and sealing said first electrode plate to a second electrode plate; and creating a vacuum between said first electrode plate and said second electrode plate.

4. The process according to claim 3, wherein said substrate is a silicon wafer.

5. The process according to claim 4, wherein said support forming material is silicon nitride.

6. The process according to claim 5, wherein said first electrode plate is at least one of a cathode conductor and an anode screen.

7. The process according to claim 6, wherein said filled mold is attached to said second electrode plate by a frit seal.

8. The process according to claim 7, further comprising the step of planarizing said support forming material in said mold using chemical mechanical planarization (CMP) prior to attaching said first electrode plate to said second electrode plate.

9. The process according to claim 8, wherein both sides of said mold are planarized using chemical mechanical planarization (CMP) prior to attaching said first electrode plate to said second electrode plate.

10. The process according to claim 9, wherein the support structures are arranged in an intersecting parallel matrix.

11. A process for the formation of interelectrode support structures, said process comprising the following steps:

sawing grooves in a selectively-etchable substrate with a micro-saw;

depositing a support forming material into said grooves of said substrate;

sealing said substrate to a first electrode plate;

etching away said selectively-etchable substrate from said support forming material;

attaching and sealing said first electrode plate to a second electrode plate; and creating a vacuum between said first electrode plate and said second electrode plate.

12. The process according to claim 11, wherein said grooves have a width of approximately 25 microns.

13. The process according to claim 12, wherein said grooves have a height of approximately 200 microns.

14. The process according to claim 13, wherein said selectively-etchable substrate is at least one of silicon or glass.

15. The process according to claim 14, wherein said support forming material comprises $Si_3N_4$.

16. The process according to claim 15, further comprising the step of planarizing said support forming material in said substrate prior to attaching said first electrode to said second electrode.

17. The process according to claim 16, wherein said selectively-etchable substrate is planarized to a height of approximately 200 microns.

18. The process according to claim 17, said first electrode is an anode screen.

19. The process according to claim 18, wherein said selectively-etchable substrate is etched away in a wet etch comprising hydrogen fluoride.

20. A process for the formation of interelectrode support structures, said process comprising the following steps: depositing a laminating layer on a selectively-etchable substrate;

sawing grooves in said selectively-etchable substrate with a micro-saw, said grooves having a tip and an opening;

injecting support forming material in said opening of said grooves;

planarizing said support forming material to expose said opening of said grooves;

removing said laminating layer;

planarizing said substrate to remove said tip of said grooves;

frit sealing said substrate to a first electrode;

etching away said substrate from said support forming material;

attaching and sealing said first electrode to a second electrode;

creating a vacuum between said first electrode and said second electrode.

* * * * *